US007509765B2

(12) United States Patent
Flores

(10) Patent No.: US 7,509,765 B2
(45) Date of Patent: Mar. 31, 2009

(54) CLIP, CLIP HAVING INSCRIBABLE LABEL, CLIP AND INSCRIBABLE LABEL KIT, AND METHODS OF MAKING AND USE THEREOF

(76) Inventor: Amal Flores, P.O. Box 16775, Los Angeles, CA (US) 90209

( * ) Notice: Subject to any disclaimer, the term of this patent is extended or adjusted under 35 U.S.C. 154(b) by 51 days.

(21) Appl. No.: 11/236,057

(22) Filed: Sep. 26, 2005

(65) Prior Publication Data

US 2007/0067966 A1 Mar. 29, 2007

(51) Int. Cl.
*G09F 3/16* (2006.01)

(52) U.S. Cl. ..... 40/666; 40/658; 40/641

(58) Field of Classification Search ..... 24/67.9, 24/67.3, 67 R, DIG. 10, 533, 552; 283/36–41; 281/15.1, 42, 45, 46; 40/641, 666, 658
See application file for complete search history.

(56) References Cited

U.S. PATENT DOCUMENTS

| | | | | | |
|---|---|---|---|---|---|
| 793,332 | A | | 6/1905 | Walker | |
| 828,542 | A | * | 8/1906 | Ellis | D6/462 |
| 898,651 | A | | 9/1908 | Hoisington | |
| 959,472 | A | | 5/1910 | Dancy et al. | |
| 1,055,397 | A | * | 3/1913 | Herold | 40/666 |
| 1,384,757 | A | * | 7/1921 | Harrison | 248/489 |
| 1,476,420 | A | * | 12/1923 | Romig | 40/666 |
| 1,783,484 | A | | 12/1930 | Ross | |
| 2,047,129 | A | | 7/1936 | Randall | |
| 2,055,152 | A | | 9/1936 | Larson | |
| 2,118,043 | A | | 5/1938 | Goza | |
| 2,186,508 | A | * | 1/1940 | Tremmel | 40/659 |
| 2,218,438 | A | | 10/1940 | Robinson | |
| D135,814 | S | * | 6/1943 | Ours | D19/65 |
| 2,478,376 | A | | 8/1949 | De Swart | |
| 2,510,508 | A | | 6/1950 | Mayer | |

(Continued)

OTHER PUBLICATIONS

Toothpick Flags (www.darachweb.com/flags/flagToothpick.html)(admitted prior art).

*Primary Examiner*—Cassandra Davis
(74) *Attorney, Agent, or Firm*—Carlos Candeloro

(57) ABSTRACT

A clip has an inner convolution, an outer convolution, a connecting element, a stem and a label. The inner convolution generally includes a first leg and a second leg. The inner convolution legs have a distal end and a proximal end and the legs are connected at their proximal ends. The outer convolution generally includes a first leg and a second leg. The outer convolution legs have a distal end and a proximal end and the legs are connected at their proximal ends. The connecting element generally connects the inner convolution to the outer convolution such that the inner and outer convolutions are disposed in a substantially common plane, with the inner convolution within the outer convolution, and such that the connected proximal end of the inner convolution legs may be flexibly moved transversely or away from the connected proximal end of the outer convolution legs. The stem is integrally formed with the rest of the clip and generally extends substantially within the plane of the first and second convolutions, in a direction substantially perpendicular to the connecting element and substantially opposite the connected proximal ends of the inner and outer convolution legs, and past the connecting element. The label is attached to the stem, and the label generally has an inscribable surface.

14 Claims, 2 Drawing Sheets

U.S. PATENT DOCUMENTS

| | | | | |
|---|---|---|---|---|
| 2,665,463 | A | | 1/1954 | Aurynger |
| 2,781,566 | A | | 2/1957 | Hammer |
| 2,827,719 | A | | 3/1958 | Nairn |
| 2,938,252 | A | | 5/1960 | Scheemaeker |
| 3,123,924 | A | | 3/1964 | Roberts |
| 3,225,469 | A | | 12/1965 | Chase |
| 3,249,978 | A | | 5/1966 | Shears |
| 3,290,810 | A | | 12/1966 | Morena |
| 3,335,467 | A | | 8/1967 | Freed |
| 3,354,564 | A | | 11/1967 | Falcone et al. |
| 3,408,700 | A | | 11/1968 | Chase |
| 3,583,358 | A | | 6/1971 | Hanson, Jr. |
| 3,616,497 | A | | 11/1971 | Esposito, Jr. |
| 3,629,912 | A | | 12/1971 | Klopp |
| 3,650,058 | A | | 3/1972 | Wittcke et al. |
| 4,011,673 | A | | 3/1977 | Levine |
| 4,019,759 | A | | 4/1977 | Stanton |
| 4,071,930 | A | | 2/1978 | Tanaka |
| 4,110,872 | A | | 9/1978 | Gould |
| 4,232,461 | A | | 11/1980 | Crawford |
| 4,261,121 | A | | 4/1981 | Coon |
| 4,277,864 | A | | 7/1981 | Orson, Jr. |
| 4,286,358 | A | * | 9/1981 | Levin ..... 24/67 R |
| D268,848 | S | | 5/1983 | Lorber |
| 4,389,755 | A | * | 6/1983 | Villa-Real ..... 24/67.9 |
| D302,280 | S | * | 7/1989 | Sanders ..... D19/65 |
| D305,036 | S | | 12/1989 | Voetsch |
| 4,914,791 | A | | 4/1990 | Lorber |
| 4,951,408 | A | | 8/1990 | Banks |
| 5,022,126 | A | | 6/1991 | Davis |
| 5,170,535 | A | | 12/1992 | Strong |
| 5,329,672 | A | * | 7/1994 | Froehlich et al. ..... 24/67.9 |
| 5,398,384 | A | | 3/1995 | Rinard |
| 5,481,784 | A | | 1/1996 | Sinaiko |
| D399,529 | S | * | 10/1998 | Shyu ..... D19/65 |
| 6,301,756 | B1 | | 10/2001 | Howard |
| 6,594,865 | B2 | | 7/2003 | O'Mahony |
| 6,612,532 | B1 | | 9/2003 | Paulus |
| 6,883,460 | B2 | | 4/2005 | Weisenfeld |
| 6,896,294 | B2 | | 5/2005 | Bidanset et al. |
| D513,521 | S | | 1/2006 | Hsu |
| D541,346 | S | | 4/2007 | Lau |
| 7,225,570 | B2 | | 6/2007 | Windorski |

* cited by examiner

CLIP, CLIP HAVING INSCRIBABLE LABEL, CLIP AND INSCRIBABLE LABEL KIT, AND METHODS OF MAKING AND USE THEREOF

FIELD OF THE INVENTION

The present invention relates to the field of stationary. More particularly, the present invention relates to the field of paper clips.

BACKGROUND OF THE INVENTION

Paper clips of several types are known in the prior art and are in widespread use. One disadvantage with prior art clips is that while they adequately serve to retain together two or more papers, they do not have a writing surface. Traditional paper clips, for example, cannot be used to post notes or label one or more documents.

U.S. Pat. No. 5,398,384 discloses a paper clip with writing surfaces on the front and back surfaces of the clip. The concept of the invention of U.S. Pat. No. 5,398,384 is to have the paper clip made of acrylic resin in which the front and back surfaces of the paper clip are utilized for writing notes thereon. However the clip disclosed in U.S. Pat. No. 5,398,384 has certain disadvantages, including the inconvenience that the inscribable surface area is dependent on the overall size of the clip. Accordingly, the clip must be relatively large to accommodate any type of inscription. Additionally, the large size of the clip and the material the clip must be formed from greatly increase the cost of manufacturing and. distributing the clips. The size of the clips also makes it burdensome to store them, whether on a desk, a drawer, or the like, and unnecessarily increases to the bulk of documents bound by the clip.

U.S. Pat. No. 2,186,508 discloses a paper clip adapted to be used as an advertising medium or a means of identification. However, the inscribable area in the clip disclosed in U.S. Pat. No. 2,186,508 is limited by the width and length of the convolutions of the paper clip.

SUMMARY OF THE INVENTION

In a first, separate aspect of the present invention, an integrally formed clip includes a stem adapted to receive a label.

In a second, separate aspect of the present invention, an integrally formed clip has an inner convolution, an outer convolution, a connecting element and a stem. The inner convolution generally includes a first leg and a second leg. The inner convolution legs have a distal end and a proximal end and the legs are connected at their proximal ends. The outer convolution generally includes a first leg and a second leg. The outer convolution legs have a distal end and a proximal end and the legs are connected at their proximal ends. The connecting element generally connects the inner convolution to the outer convolution such that the inner and outer convolutions are disposed in a substantially common plane, with the inner convolution within the outer convolution, and such that the connected proximal end of the inner convolution legs may be flexibly moved transversely or away from the connected proximal end of the outer convolution legs. The stem, which may be integrally formed with the rest of the clip, generally extends substantially within the plane of the first and second convolutions, in a direction substantially perpendicular to the connecting element and substantially opposite the connected proximal ends of the inner and outer convolution legs, and past the connecting element.

In a third, separate aspect of the present invention, a clip structure includes a generally planar J-shaped section, a generally planar U-shaped section and a connecting U-shaped bight portion. The J-shaped section generally includes a stem, a free leg, a semicircular bight portion and a continuation leg. The generally planar U-shaped section includes a free leg, a semi-circular bight portion and a continuation leg. The U-shaped section is nested between the legs of the J-shaped section. The connecting U-shaped bight portion connects the J-shaped section continuation leg and the U-shaped section continuation leg.

In a fourth, separate aspect of the present invention, a clip of the present invention further includes a label attached to the stem. The label allows inscriptions to be made thereon. The labeled clip may be used to label a document by attaching the labeled clip to the document.

In a fifth, separate aspect of the present invention, a kit includes a container having a clip in accordance with the present invention and a label in accordance with the present invention.

In a sixth, separate aspect of the present invention, a document is labeled by the application of a labeled clip of the present invention to the document.

Accordingly, objects of the present invention include a clip that may bear a label and a method of labeling one or more documents. Other and further objects and advantages will appear hereinafter.

DETAILED DESCRIPTION OF THE PREFERRED, EMBODIMENTS

Figure 1:
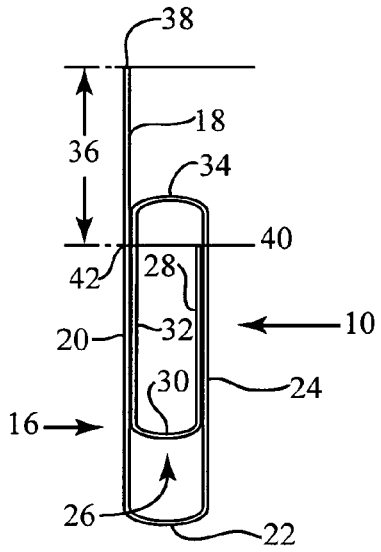
FIG. 1 is a plan view of a clip in accordance with an embodiment of the present invention.
Figure 2:
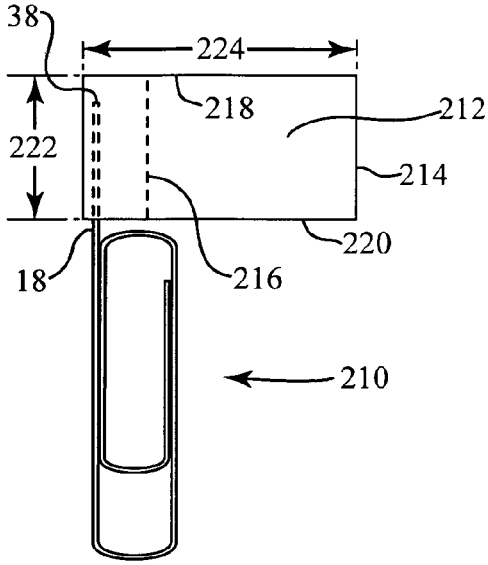
FIG. 2 is a plan view of a clip with a label in accordance with an embodiment of the present invention.
Figure 3:
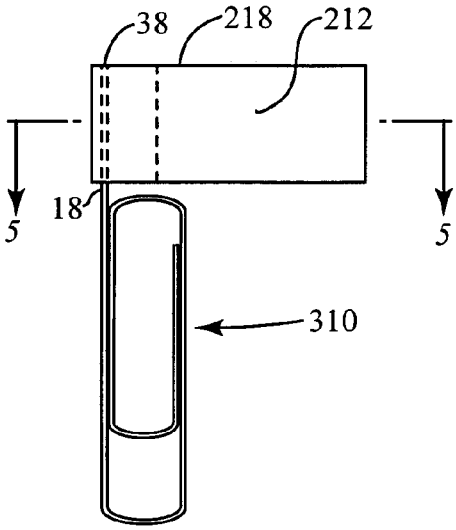
FIG. 3 is a plan view of a clip with a label in accordance with another embodiment the present invention.
Figure 4:
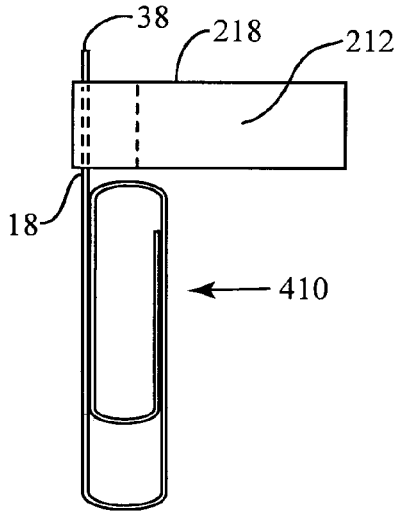
FIG. 4 is a plan view of a clip with a label in accordance with another embodiment the present invention.
Figure 5:
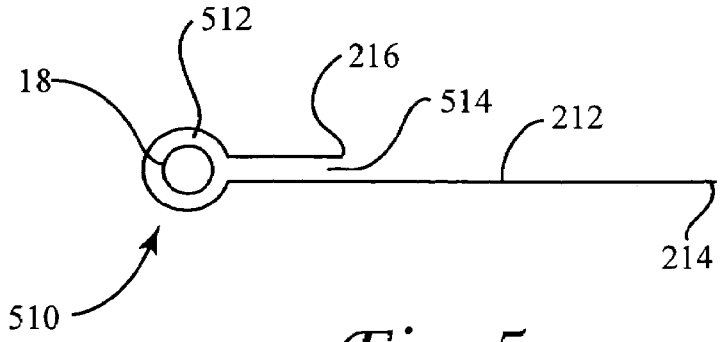
FIG. 5 is a cross-section view of a clip with a label in accordance with an embodiment the present invention.
Figure 6:
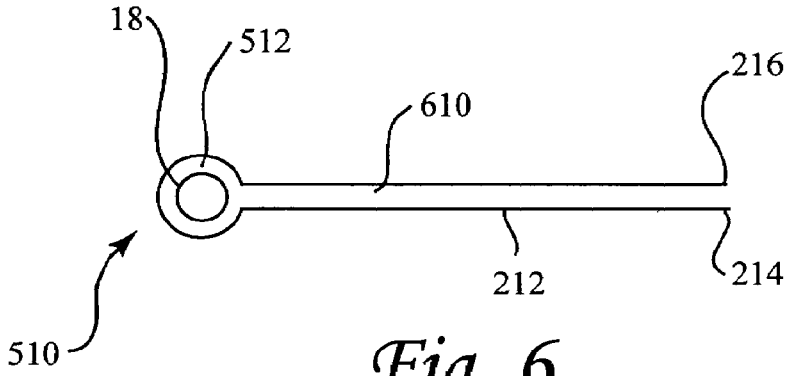
FIG. 6 is a cross-section view of a clip with a label in accordance with another embodiment the present invention.
Figure 7:
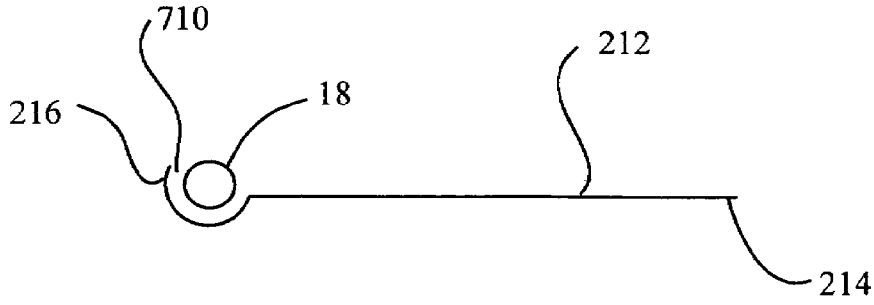
FIG. 7 is a cross-section view of a clip with a label in accordance with another embodiment the present invention.

Turning in detail to the drawings, where like reference characters designate like parts. A clip is illustrated in FIG. 1 and a clip bearing a label is illustrated in FIGS. 2 through 4. FIGS. 5 through 7 are cross-sections that illustrate by example how a label may be attached to the stem of a clip of the present invention. Naturally, it is understood that the disclosed clips are merely illustrative of the types which may be employed with the same advantages enjoyed as by use of the illustrated clips.

A clip in accordance with an embodiment of the present invention 10 includes a generally planar J-shaped section 16, which has a stem 18, a free leg 20, a semicircular bight portion 22 and a continuation leg 24. The clip 10 also includes a generally planar U-shaped section 26, which has a free leg 28, a semi-circular bight portion 30 and a continuation leg 32 nested between the legs 20 24 of the J-shaped section 16. The J-shaped section 16 and U-shaped section 26 are connected by a connecting U-shaped bight portion 34 connecting the J-shaped section and the U-shaped section continuation legs 24 32.

While the bight portions 22 30 are described as semicircular, they may be of any effective shape, including, for example, V-shaped.

The clip may be formed in any effective manner and of any effective material. In one embodiment it is formed of a continuous length of wire, plastic covered wire, or the like. In another embodiment, the clip may be formed of a plastic, or the like.

The stem 18 is adapted to receive a label, and may be disposed on the clip in any effective manner. In the embodiments shown in FIGS. 1-4 the stem 18 extends linearly from the free leg 20 of the J-shaped section 16.

The stem 18 may be of any effective length. In accordance with an embodiment of the present invention, the length 36 of the stem 18 may be measured from the tip of the stem 38 to where an imaginary line 40 perpendicular to the legs of the clip 20 24 28 32 and resting where the tip of the U-shaped section free leg 28 intersects 42 the J-shaped section free leg 20.

Generally, the length 36 of the stem 18 will be related to the size of the clip 10 and the label to be attached to it. Generally, the stem extends past the connecting bight 34. For example, the length 36 of the stem 18 may be in the range from about 5 millimeters to about 10 centimeters. Generally, the stem will be in the range from about 1.5 to about 3.0 centimeters.

FIGS. 2-4 illustrate labeled clips in accordance with further embodiments of the present invention. FIGS. 2, 3 and 4 illustrate a labeled clip 210 310 410 having a stem 18 and a label 212 attached thereto.

Any effective label 212 may be used in accordance with the present invention. The label is adapted to be affixed to the stem 18 of the clip, and is preferably of a material that can be inscribed, printed on, written on, or the like.

The label may be of any effective geometric shape. For example, as shown in FIGS. 2-4, the label 212 may be rectangular, having four edges, a first lateral edge 214, a second lateral edge 216, a top edge 218, and a bottom edge 220. However other shapes, including triangles, circles, and the like may be used. The label may be of any color, including white, red, orange, yellow, green, blue, indigo, pink, violet, black, transparent and the like.

The label 212 may be of any effective size. Generally, the label 212 should have a surface area sufficient to provide an inscribable surface. The width 222 and length 224 of the label will generally be related to the size of the clip and the length 36 of the stem 18. For example, the label may have a width 222 of from about 3 millimeters to about 20 centimeters and a length 224 of from about 3 millimeters to about 20 centimeters. In other embodiments, the label has a width 222 within the range of from about 1 centimeter to about 5 centimeters and a length 224 within the range of from about 2 centimeters to about 7 centimeters.

In one embodiment, the label 212 includes a tear away section, detachable portion, stub or the like (not shown). The label's tear away section, detachable portion, stub or the like, may be generated in any effective manner, including, for example, perforating the label along a line delimiting the tear away section, detachable portion, stub or the like.

The label 212 may be affixed to the stem in any effective position. For example, as illustrated in FIGS. 2-4, the label 212 may be affixed such that the top edge 218 of the label 212 extends further than the tip 38 of the stem 18 (FIG. 2), alternatively the label 212 may be affixed such that its top edge 218 is flush with the tip 38 of the stem 18 (FIG. 3). In another alternative embodiment the label 212 may be affixed such that the tip 38 of the stem 18 extends further than the top edge 218 of the label 212 (FIG. 4).

The bottom edge 220 of the label 212, may extend to any effective position down the stem 18 and even into the free leg 20 of the J-shaped section 16.

While FIGS. 2-4 illustrate the label 212 as being in the same plane as the clip, and extending from the stem 18 in the same direction as the clip 10, in accordance with different embodiments of the present invention the label 212 may affixed in any effective orientation around the stem 18.

The label 212 may be affixed to the stem 18 in any effective manner. Generally, the label 212 may be adhered to the stem 18. In one embodiment, shown in FIGS. 2-4, and in cross-section view in FIG. 5, the label 218 is affixed to the stem 18 by folding the label 212 around 510 the stem 18 and adhering the label 212 to the stem 18, 512 and to itself 514. When folded over and adhered to itself, the second lateral edge 216 may extend to any effective length. For example, as shown in FIG. 6, the second lateral edge 216 may extend as far as the first lateral edge 214 and may be partially adhered to itself, or fully adhered to itself 610 as shown in FIG. 6.

As shown in FIG. 7, the label 212 may also be adhered 710 directly to the stem 18 without folding the label 212 over itself.

While FIGS. 5 through 7 show the cross-section of the stem 18 as being circular, naturally the cross-section of the stem may be of any effective design. For example, it may be hexagonal, extended hexagonal (e.g., wherein two opposing parallel sides are longer than the other 4 sides of the hexagon), circular, elliptical, tear drop shaped, ovoid, two straight parallel sides connected by semicircular sections, and the like.

While a clip in accordance with an embodiment of the present invention has been described based on a clip formed of a continuous length of wire, clips having a stem to which a label may be attached, and labeled clips in accordance with the present invention, may be of any effective design and constructed out of any effective material. For example, the stem may be integrally formed extending from the transverse web of an injection molded clip, as described, for example, in U.S. Pat. Nos. 4,914,791, 3,673,641 (which are included herein by reference as if fully set forth herein), and the like.

In another embodiment of the present invention, a kit includes a container having within it a clip in accordance with the present invention and a label in accordance with the present invention. The kit may include any effective label. In one embodiment, the label is of the "self-adhesive" type. The label may, for example, have substantially full pressure-sensitive adhesive, or the like, coverage on one of its faces, as shown in FIG. 6, or, alternatively, it may have a partial coverage, wherein only an area sufficient for adhesion of the label to itself, and/or the stem when it is folded over the stem, for example, as shown in FIGS. 5 and 7. The label may be disposed on a sheet adapted to be used with a printer.

A clip or labeled clip according to the present invention may be used in any effective manner. Generally, a document may be labeled by inscribing a label, or a labeled bearing clip, in accordance with an embodiment of the present invention. In the case of a labeled clip the clip may be directly fasted to the document to be labeled. Otherwise, the inscribed label may be attached to the clip, and the clip fasted to the document to be labeled. A clip with an un-inscribed label may also be used to "flag" a document.

Accordingly, a method is described for labeling a document, including inscribing a label, wherein the label comprises an inscribable area and an adhesive area; adhering said inscribed label to a stem of a clip, wherein the clip comprises a substantially planar substantially J-shaped first section comprising a stem, a first section free leg, a substantially semicircular first section bight portion and a first section continuation leg, a substantially planar substantially U-shaped second section comprising a second section free leg, a substantially semi-circular second section bight portion and a second section continuation leg nested between the free leg and the continuation leg of said first section, a substantially U-shaped connecting bight portion connecting the first section continuation leg and the second section continuation leg; applying said labeled clip to a document.

As used herein the term "document" includes any object or set of objects which a clip of the present invention may be fastened to.

Accordingly, a clip that can group pages together and mark and/or label a single page or a group of pages has been described. The clip allows for easily sorting and identifying marked pages and can be adjustable and reusable.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A clip comprising a substantially planar substantially J-shaped first section comprising a stem, a first section free leg, a substantially semicircular first section bight portion and a first section continuation leg;

a substantially planar substantially U-shaped second section comprising a second section free leg, a substantially semi-circular second section bight portion and a second section continuation leg nested between the free leg and the continuation leg of said first section;

a substantially U-shaped connecting bight portion connecting the first section continuation leg and the second section continuation leg;

wherein the stem extends past the connecting bight and consists essentially of a rectilinear structure extending substantially within the plane of said first and second sections in a direction substantially perpendicular to the connecting bight;

a label, wherein the label is adhered to the stem and is positioned entirely above the U-shaped connecting bight portion.

2. The clip of claim 1 wherein the stem has a length from between about 3 millimeters to about 20 centimeters.

3. The clip of claim 2, wherein the label has a width from about 3 millimeters to about 20 centimeters.

4. The clip of claim 2, wherein the label has a length from about 3 millimeters to about 20 centimeters.

5. The clip of claim 2, wherein the label has a width from about 1 centimeter to about 5 centimeters.

6. The clip of claim 2, wherein the label has a length from about 2 centimeters to about 7 centimeters.

7. A kit comprising a) a container;

b) a clip comprising a substantially planar substantially J-shaped first section comprising a stem, a first section free leg, a substantially semicircular first section bight portion and a first section continuation leg, a substantially planar substantially U-shaped second section comprising a second section free leg, a substantially semi-circular second section bight portion and a second section continuation leg nested between the free leg and the continuation leg of said first section, a substantially U-shaped connecting bight portion connecting the first section continuation leg and the second section continuation leg, wherein the stem consists essentially of a rectilinear structure extending substantially within the plane of said first and second sections in a direction substantially perpendicular to the connecting bight, the stem extending past the connecting bight;

c) a label adapted to be affixed to said stem, the label comprising a first surface area, wherein said first surface area comprises an inscribable surface, and a second surface area, wherein said second surface area comprises an adhesive; wherein said clip and said label are contained within said container; said label is positioned entirely above the U-shaped connecting bight portion.

8. An integrally formed clip comprising an inner convolution comprising a first leg and a second leg, said first inner convolution leg comprising a distal end and a proximal end and said second inner convolution leg comprising a distal end and a proximal end, wherein said first and second inner convolution legs are connected at their proximal ends;

an outer convolution comprising a first leg and a second leg, said first outer convolution leg comprising a distal end and a proximal end and said second outer convolution leg comprising a distal end and a proximal end, wherein said first and second outer convolution legs are connected at their proximal ends;

a connecting element that connects said inner convolution to said outer convolution such that said inner and outer convolutions are disposed in a common plane, said inner convolution within said outer convolution, and such that said connected proximal end of said inner convolution may be moved transversely or away from said connected proximal end of said outer convolution;

an integrally formed stem extending substantially within the plane of said first and second convolutions in a direction substantially perpendicular to said connecting element and substantially opposite said connected proximal ends of said inner and outer convolutions, wherein said stem consists essentially of a rectilinear structure that is positioned entirely above the aid connecting element.

9. The clip of claim 8 wherein the stem has a length from between about 3 millimeters to about 20 centimeters.

10. The clip of claim 8 further comprising a label attached to the stem.

11. The clip of claim 10, wherein the label has a width from about 3 millimeters to about 20 centimeters.

12. The clip of claim 10, wherein the label has a length from about 3 millimeters to about 20 centimeters.

13. The clip of claim 10, wherein the label has a width from about 1 centimeter to about 5 centimeters.

14. The clip of claim 10, wherein the label has a length from about 2 centimeters to about 7 centimeters.

* * * * *